US007703607B2

(12) United States Patent
Wilkins

(10) Patent No.: US 7,703,607 B2
(45) Date of Patent: Apr. 27, 2010

(54) CARTON WITH REMOVABLE PORTION

(75) Inventor: Zoe Claire Wilkins, Bristol (GB)

(73) Assignee: Graphic Packaging International, Inc., Marietta, GA (US)

( * ) Notice: Subject to any disclaimer, the term of this patent is extended or adjusted under 35 U.S.C. 154(b) by 969 days.

(21) Appl. No.: 10/987,070

(22) Filed: Nov. 12, 2004

(65) Prior Publication Data

US 2005/0103652 A1 May 19, 2005

(30) Foreign Application Priority Data

Nov. 13, 2003 (GB) ..... 0326434.8

(51) Int. Cl.
*B65D 75/00* (2006.01)

(52) U.S. Cl. ..... 206/434; 206/429; 206/427; 206/139

(58) Field of Classification Search ..... 206/427, 206/429, 434, 139; 229/103.2, 200, 235, 229/240, 242, 89; 221/32, 305, 309
See application file for complete search history.

(56) References Cited

U.S. PATENT DOCUMENTS

| | | | | |
|---|---|---|---|---|
| 2,929,497 A | | 3/1960 | De Million-Czarnecki | |
| 2,936,069 A | | 5/1960 | Dunning | |
| 3,128,010 A | | 4/1964 | Forrer | |
| 4,375,258 A | * | 3/1983 | Crayne et al. | 206/141 |
| 4,382,505 A | | 5/1983 | Sutherland et al. | |
| 4,566,593 A | * | 1/1986 | Muller | 206/434 |
| 4,588,084 A | * | 5/1986 | Holley, Jr. | 206/427 |
| 5,180,054 A | * | 1/1993 | Bakx | 206/140 |
| 5,421,458 A | * | 6/1995 | Campbell | 206/434 |
| 6,250,542 B1 | * | 6/2001 | Negelen | 229/117.16 |
| 6,550,615 B2 | * | 4/2003 | Lingamfelter | 206/427 |

FOREIGN PATENT DOCUMENTS

| | | |
|---|---|---|
| DE | 25 42 924 A1 | 3/1977 |
| EP | 0 447 243 A1 | 9/1991 |
| GB | 1103372 | 2/1968 |
| NL | 8901957 | 2/1991 |

OTHER PUBLICATIONS

Search Report: GB0326434.8, Mar. 26, 2004.
Examination Report for GB0326434.8, Jan. 10, 2007.

* cited by examiner

*Primary Examiner*—J. Gregory Pickett
(74) *Attorney, Agent, or Firm*—Womble Carlyle Sandridge & Rice, PLLC

(57) ABSTRACT

There is provided a carton having a top panel, side panels and base panels. The carton has a removable portion, defined by lines of weakening, which removable portion when removed exposes a single top area which shows at least part of the tops of all of the articles held in the carton. In preferred arrangements, a single top area of the panel remains at one of the ends of the carton.

11 Claims, 3 Drawing Sheets

CARTON WITH REMOVABLE PORTION

RELATED APPLICATION

This application claims priority under 35 U.S.C. §119(a) to British application serial no. GB 0326434.8, filed on Nov. 13, 2003, the entire contents of which are hereby incorporated by reference.

BACKGROUND

1. Technical Field

This invention relates to paperboard cartons.

2. Background Art

It is well known for articles such as cans and bottles to be distributed in multipacks such as paperboard sleeves in which are retained a plurality of articles in a number of rows. These can be sold as a multipack to a consumer but sometimes the retailer may wish to display the product and sell the articles individually.

SUMMARY

According to the present invention there is provided a paperboard carton for retaining a plurality of articles in a number of adjacent rows the carton providing a top panel, a pair of hingedly connected side panels provided at opposite side edges of the top panel and a base panel arrangement extending between and connecting the lower edges of the side panels, the carton having a removable portion which, when removed exposes a single top area showing at least part of the tops of all of the articles.

Ideally said removable portion is defined by one or more lines of weakening, such as lines of perforations or paperboard zips. In a further preferred arrangement a portion of the top panel remains adjacent one of the ends of the carton after the removable portion has been removed.

Preferably retention means are provided at one or both ends of the carton to prevent removal of the articles from the carton prior to removal of the removable portion. Conveniently said retention means comprises top gusset panels which extend between the top panel and the respective side panels at the ends of the carton so as to partially block the ends of the carton. However, in some embodiments said retention means comprises bottom gusset panels which extend between the base panel arrangement and the respective side panels at the ends of the carton so as to partially block the ends of the carton. It is a preferred feature that each gusset panel comprises two portions, the first of which is hingedly connected to the top/bottom panel and the second of which is hingedly connected to the associated side panel, both portions being hingedly connected together such that one of the portions is bent toward its associated adjacent panel to allow the other portion to extend across an open end area of the carton. Ideally said one portion of each gusset panel is, in use, held against its associated adjacent panel by one of said articles.

In some arrangements said retention means comprises aperture formations each for receiving a top edge or a bottom edge of one of the articles.

A further preferred feature is that the base panel arrangement comprises a base panel hingedly connected to the lower edge of each side panel, the two base panels being secured with respect to each other. In some embodiments the two base panels have interengaging formations to effect their securing with respect to each other.

In a preferred arrangement the line of weakening stars at one end edge of one side panel below a top gusset panel and extends at an angle to the top edge of the side panel then across the top panel to the top edge of the other side panel and back at an angle to the end edge of the other side panel below the gusset panel.

BRIEF DESCRIPTION OF THE FIGURES

Embodiments of the invention will now be described in more detail. The description makes reference to the accompanying drawings in which.

DETAILED DESCRIPTION

Figure 1:
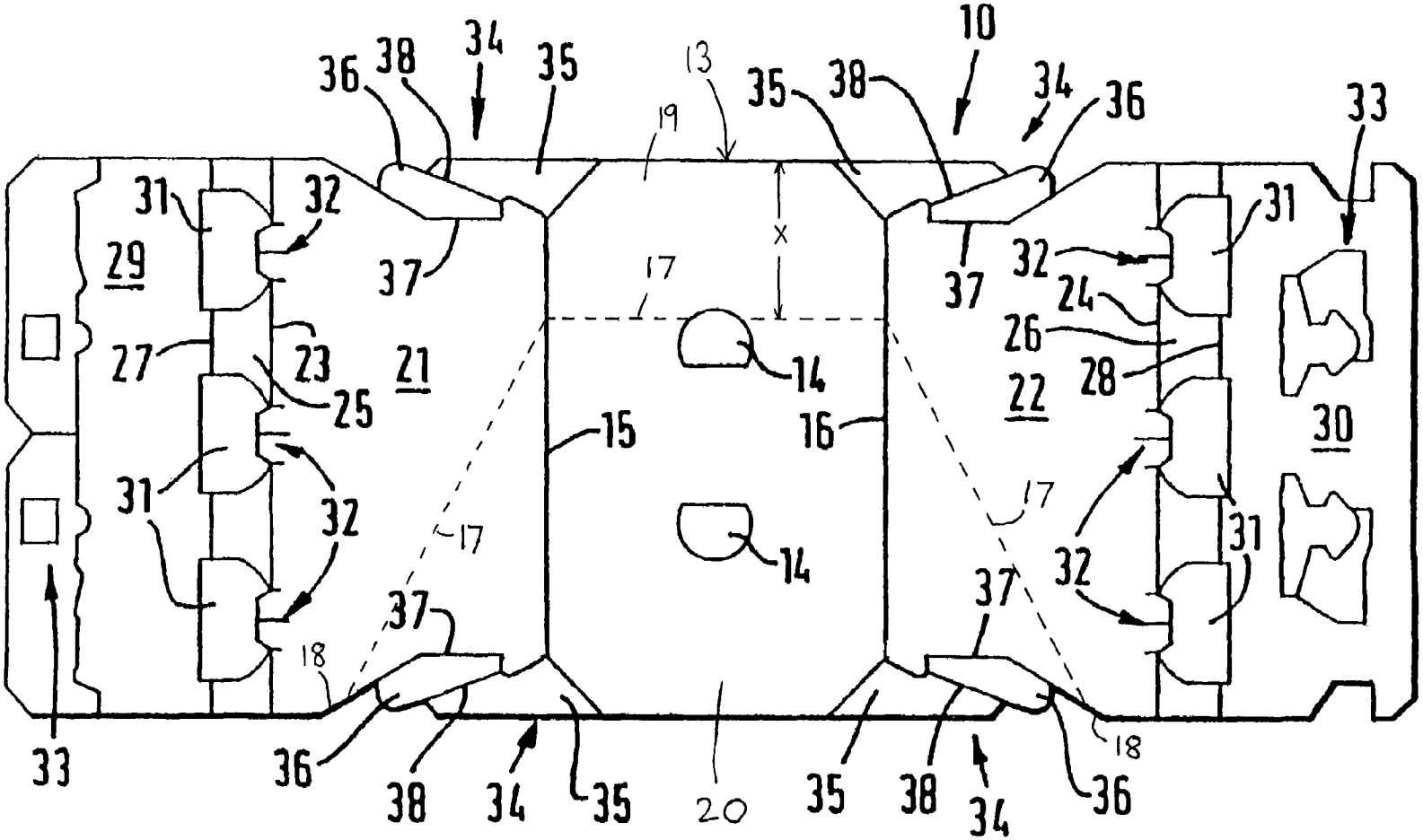
FIG. 1 shows a blank for producing a carton according to the present invention.
Figure 2:
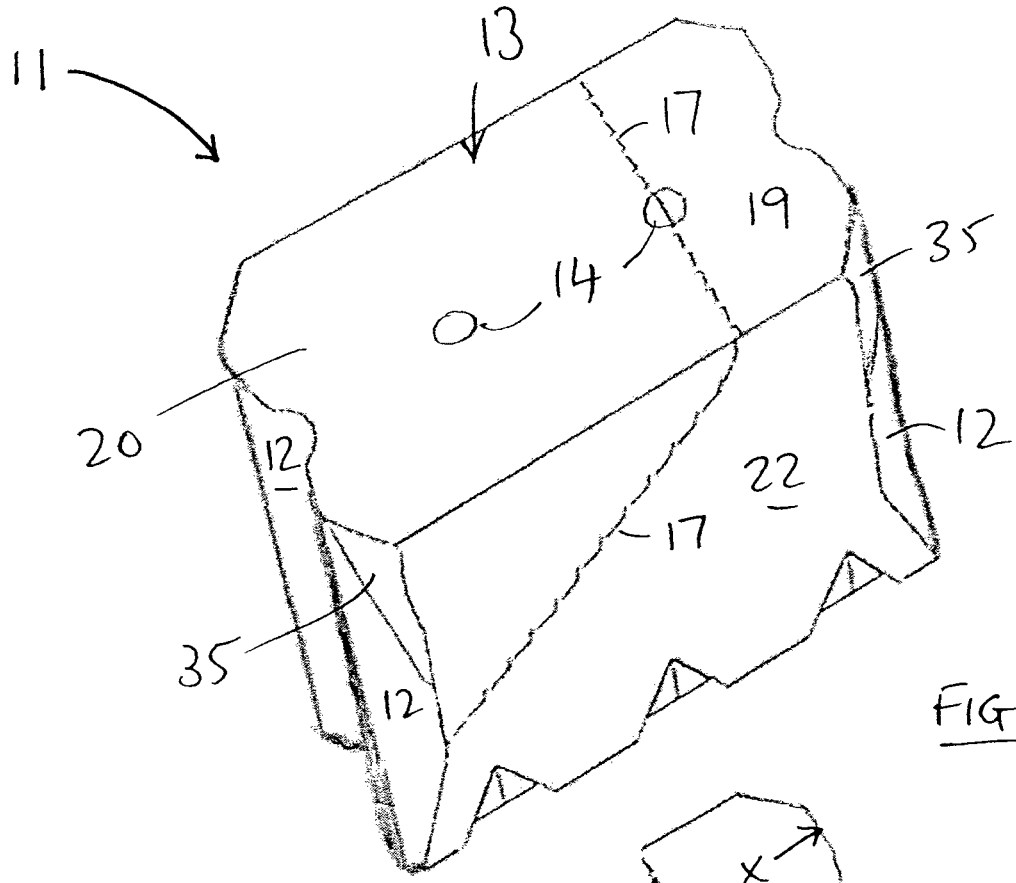
FIG. 2 is a perspective view of a carton according to the present invention.
Figure 3:
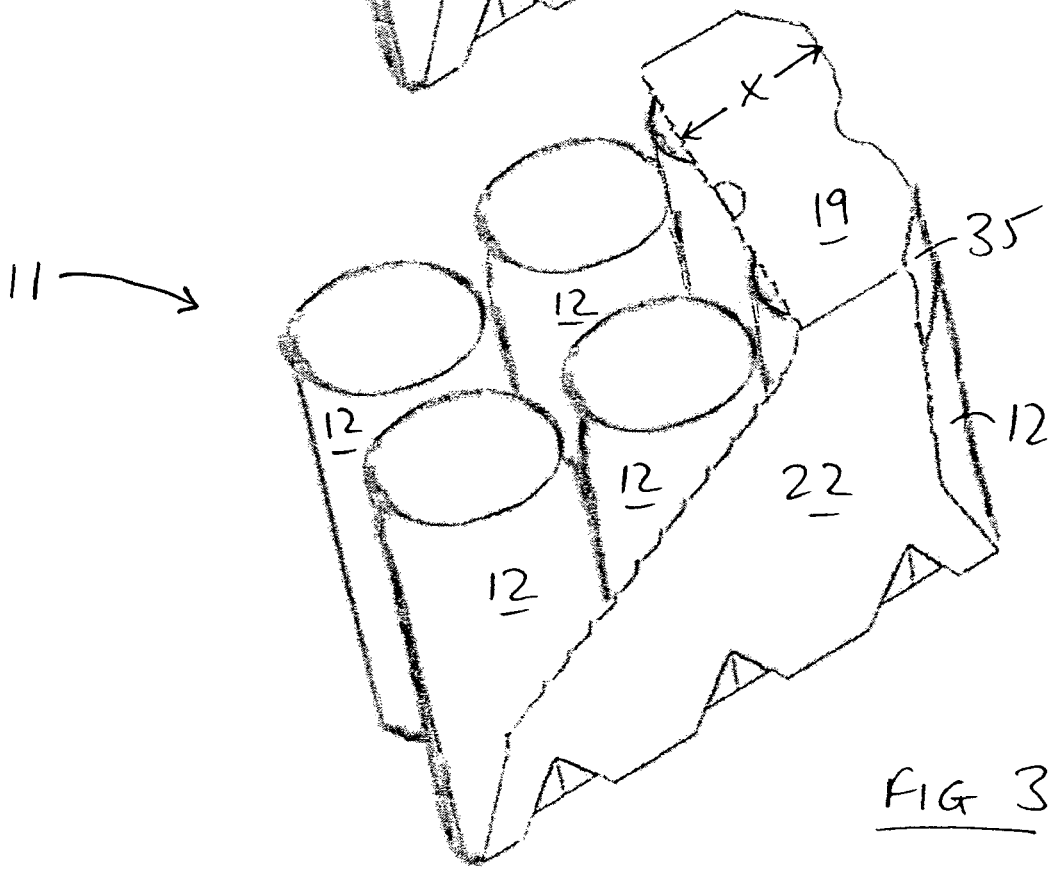
FIG. 3 is a perspective view of the carton of FIG. 2 after a portion has been removed.

FIG. 1 shows a paperboard blank 10 for forming a carton 11, as shown in FIGS. 2 and 3, around a plurality of articles which in this case is six cans 12 arranged in two rows of three. Other can arrangements are possible with more than two rows and more than thee cans in each row. The carton 11 has a top panel 13 formed with two finger holes 14 for facilitating the carrying of the carton. Hingedly connected to each side edge of the top portion along fold lines 15, 16 are main side panels 21, 22. Hingedly connected to the lower edges of the side panels 21, 22 along fold lines 23, 24 are lower side panels 25, 26 which in turn are connected along fold lines 27, 28 to base panels 29, 30.

The panels 21, 25, 29; 22, 26, 30 are formed with apertures 31 and formations 32 for engaging and retaining heel portions of the cans 12. As can be seen in FIG. 2, the heel of the can protrudes to some extent through the aperture 31 and this serves to prevent to a great extent transverse movement of the can 12 within the carton 11.

The base panels 29, 30 are provided with various formations 33 which are arranged so as to interlock and interengage so as to close the blank 10 to form the sleeve-like carton 11.

The blank 10 is also formed with gusset panels 34 which interconnect each side panel 21, 22 with the top panel 13. Each gusset portion 34 has a first portion 35 hingedly connected to the top panel 13 and a second portion 36 hingedly connected to the side panel 21, 22 along the fold line 37. The first and second portions 35, 36 are also hingedly connected together along fold line 38.

When forming the carton 11 around the cans 12, the top panel is placed across the tops of the cans and the side panels and bottom panels are folded around the cans 12. During the folding, the second portions 36 of the gusset portions 34 are tucked in behind their associated side panels 21, 22 and the bottom panels 29, 30 are connected together. These second portions 36 and the lower part of the first portions 35 are, in the finished carton 11, sandwiched in position between the cans 12 and the side panels 21, 22 and cannot readily be pulled out. In the finished carton 11 the first portions 35 of the gusset portions 34 partially block the open end areas the carton and thereby prevent the tops of the cans from being removed from the carton.

One or more lines of weakness 17 are provided in the side panels 21, 22 and the top panel 13. The line of weakness extends at an angle from an end edge 18 of one side panel 21 below the second portion 36 of the adjacent gusset to the fold line 15, across the top panel 13 to the fold line 16 and back at an angle to the end edge 18 of the other side panel 22, again below the second portion 36 of the adjacent gusset. The line of weakness can be a perforated line or a partially cut line as shown, although other alternatives would be apparent to the skilled person.

The location of the line of weakness 17 in the top panel 13 is such that a retained portion 19 of the top panel 13 remains in tact after the removable portion 20 defined by the line of weakness 17 has been removed. The width X of the retained portion 19 is such that at least a portion of the tops of all of the cans 12 is exposed after removal of the removable portion 20. This enables the multipack carton 11 to be used as a display pack for selling individual cans because the retailer can simply remove the removable portion 20 prior to placing the remaining part of the carton with the cans on the shelf. The cans are very visible but remain together as the carton is not completely removed. At least a part of all of the can tops are exposed to enable easy removal of the cans.

Figure 4:
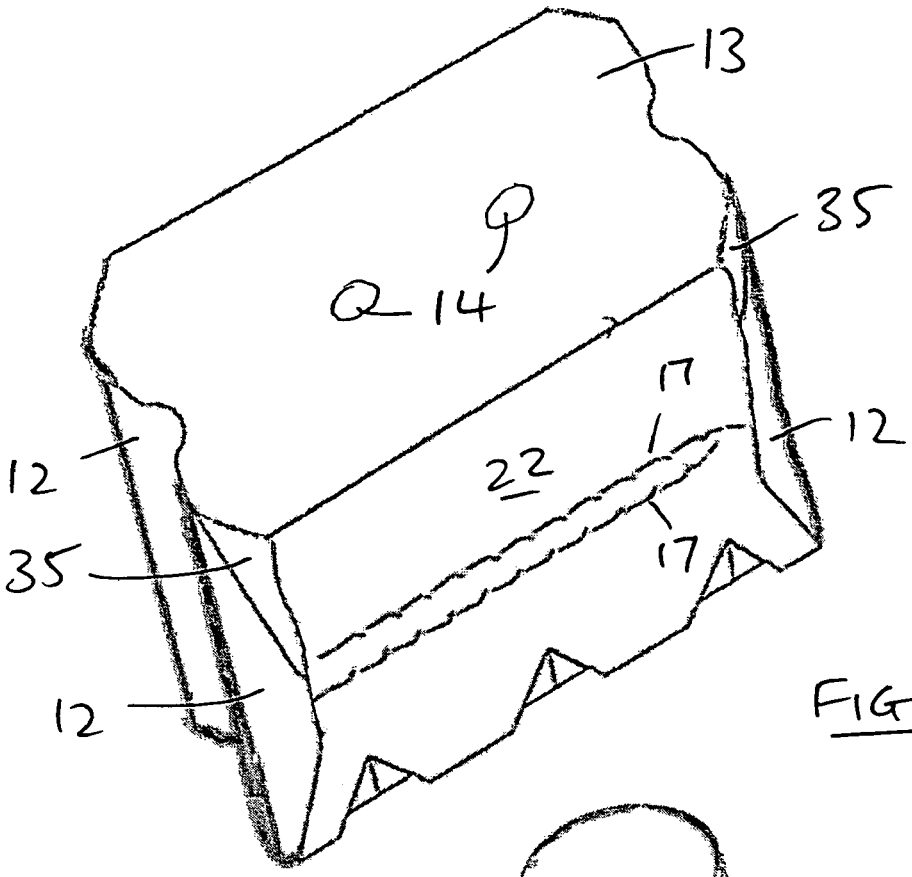
FIGS. 4 and 5 are perspective views similar to FIGS. 2 and 3 of an alternative carton according to the present invention.
Figure 5:
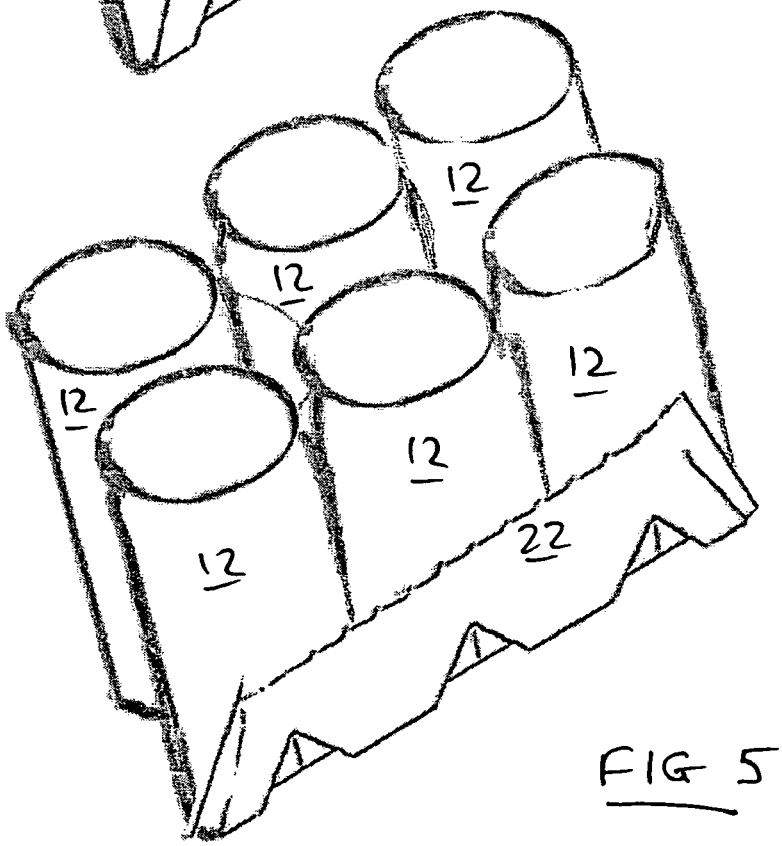

In the embodiment shown in FIGS. 4 and 5 two adjacent lines of weakening 17 in the form of a paperboard zip extend straight across each of the side panels 21, 22 below the gusset portions 35, 36. In this embodiment the entire top of the carton is removed to expose the cans 12 which are retained in the remaining lower part of the carton.

It will be appreciated that articles other than cans can be used in the above described carton. For example, the carton could be adapted for use with bottles. Also different types of can would require slightly modified panel arrangements. In other arrangements, bottom gusset panels could be provided instead of the heel retaining aperture 31/formations 32.

In addition, it will be appreciated that other bottom panel securing techniques are envisaged, for example different formations 33 may be used or the two panels may simply be secured with adhesive. Also the connection between the ends of the blank has been shown as being in the base area, but it will be appreciated that it could be located in a side or the top portion if required. Further modifications may include further fold lines in the first gusset portion if desired or in any other panel so as to accommodate features of the articles being contained.

What is claimed:

1. A carton and a plurality of cans arranged in the carton in a plurality of columns and rows, comprising:

a top panel;

a first side panel hingedly connected to the top panel;

a second side panel hingedly connected to the top panel;

at least one base panel hingedly connected to at least one of the side panels; and two gusset panels at each end of the carton, each gusset panel comprising:

a first portion hingedly connected to the top panel; and a second portion hingedly connected to the first portion and hingedly connected to an adjacent one of the side panels, each second portion being bent toward the adjacent side panel and held in place by an abutting one of the cans so that the first portion extends across an open end area of the carton, wherein a removable portion is defined in the top panel and side panels by at least one line of weakening, the removable portion including the gusset panels at one end of the carton, wherein when the removable portion is removed by separating the removable portion along the at least one line of weakening, at least a part of a top of all of the cans is exposed, and when the removable portion is removed, a remaining portion of the top panel remains adjacent one of the ends of the carton and over at least one of the cans at a top of the carton.

2. The carton of claim 1, wherein the at least one line of weakening comprises a first oblique line of weakening in the first side panel and a second oblique line of weakening in the second side panel.

3. The carton of claim 1, wherein the line of weakening starts at one end edge of the first side panel and extends at an angle to a first top edge of the first side panel then across the top panel to a top edge of the second side panel and back at an angle to an end edge of the second side panel.

4. The carton of claim 1, further comprising a plurality of aperture formations in the at least one base panel, each aperture formation receiving a bottom edge of one of the cans.

5. The carton of claim 1, wherein the at least one base panel comprises a first base panel hingedly connected to the first side panel and a second base panel hingedly connected to the second side panel.

6. The carton of claim 5, further comprising a plurality of aperture formations in each base panel, each aperture formation receiving a bottom edge of one of the cans.

7. The carton of claim 6, wherein the two base panels have interengaging formations securing the base panels together.

8. The carton of claim 6, further comprising bottom gusset panels which extend between the at least one base panel and an adjacent side panel.

9. The carton of claim 3, wherein the first portions are hingedly connected to the top panel at oblique fold lines.

10. A paperboard carton and a plurality of cans arranged in two rows and three columns, comprising:

a top panel;

a first side panel hingedly connected to the top panel;

a second side panel hingedly connected to the top panel;

a first base panel hingedly connected to the first side panel;

a second base panel hingedly connected to the second side panel, the first and second base panels being secured together;

a plurality of aperture formations in each base panel, each aperture formation receiving a bottom edge of one of the cans; and two gusset panels at each end of the carton, each gusset panel comprising:

a first portion hingedly connected to the top panel; and a second portion hingedly connected to the first portion along an oblique fold line and hingedly connected to an adjacent one of the side panels, each second portion being bent toward the adjacent side panel and held in place by an abutting one of the cans so that the first portion extends across an open end area of the carton, wherein a removable portion is defined in the top panel and side panels by at least one line of weakening, the removable portion including the gusset panels at one end of the carton, wherein when the removable portion is removed by separating the removable portion along the at least one line of weakening, at least a part of a top of all of the cans is exposed, and when the removable portion is removed, a remaining portion of the top panel remains adjacent one of the ends of the carton and over at least one of the cans at a top of the carton.

11. The carton of claim 10, wherein the first portions are hingedly connected to the top panel at oblique fold lines.

* * * * *